United States Patent [19]

Barker et al.

[11] 4,102,107

[45] Jul. 25, 1978

[54] PREFABRICATED SHINGLE PANELS

[75] Inventors: Frank S. Barker, Pompano Beach, Fla.; Willis G. Pehl, Chehalis, Wash.

[73] Assignee: Shakertown Corporation, Winlock, Wash.

[21] Appl. No.: 504,317

[22] Filed: Sep. 9, 1974

Related U.S. Application Data

[62] Division of Ser. No. 48,255, Jun. 22, 1970, abandoned.

[51] Int. Cl.[2] ..... E04D 1/20

[52] U.S. Cl. ..... 52/553; 52/478; 52/535; 52/551; 52/560

[58] Field of Search ..... 52/535, 545, 547, 550, 52/551, 553, 560, 459, 460, 462, 478, 557, 540, 555, 519, 559; 144/13, 309 Q, 316; 161/40; 156/71

[56] References Cited

U.S. PATENT DOCUMENTS

| | | | |
|---|---|---|---|
| 685,102 | 10/1901 | Chrestien | 52/553 |
| 1,536,519 | 5/1925 | Parker | 52/551 |
| 1,702,609 | 2/1929 | Lesher | 52/557 X |
| 1,958,560 | 5/1934 | Beckman | 52/557 |
| 2,110,579 | 3/1938 | Robinson | 52/560 |
| 2,148,167 | 2/1939 | Lyman | 52/478 |
| 2,149,741 | 3/1939 | Miles | 52/553 |
| 2,151,794 | 3/1939 | Peebles | 52/553 |
| 2,164,712 | 7/1939 | Kirschbraun | 52/547 |
| 2,172,010 | 8/1939 | Schuetz et al. | 52/555 |
| 2,232,786 | 2/1941 | Kendall | 52/557 X |
| 2,384,686 | 9/1945 | Kraus | 52/540 |
| 2,501,221 | 3/1950 | Humble | 52/535 |
| 2,727,283 | 12/1955 | Gollner | 52/535 |
| 2,934,110 | 4/1960 | Barker | 144/13 |
| 2,935,768 | 5/1960 | Roupe | 52/560 X |
| 3,068,920 | 12/1962 | Chandler et al. | 198/203 X |
| 3,083,506 | 4/1963 | Cacossa | 52/551 |
| 3,095,671 | 7/1963 | Fink et al. | 52/551 |
| 3,262,239 | 7/1966 | Mills | 52/540 |
| 3,333,384 | 8/1967 | Brady | 52/560 |
| 3,546,843 | 12/1970 | Luebs | 52/560 |

FOREIGN PATENT DOCUMENTS

| | | | |
|---|---|---|---|
| 10,454 | 6/1895 | Switzerland | 52/478 |

*Primary Examiner*—Leslie Braun
*Attorney, Agent, or Firm*—Robert W. Beach

[57] ABSTRACT

A shingle panel includes a backing board underlying and secured to the tips of shingles laid in a row to form a course. The lengths of the shingles, extending transversely of the length of the backing board, are more than twice the width of the backing board so that the butts of the shingles overhang the backing board a distance greater than the backing board width. The panels are assembled in successive courses in substantially coplanar relationship with the backing boards in edge abutment to form continuous sheathing, and the shingles will be disposed in the overlapping relationship of a conventional roof or side wall. The exposure width of the shingles is established by the width of the backing boards. Leakage through the cracks between adjacent shingles is prevented by providing a sheet underlying a portion of the overhanging shingle length of a width at least as wide transversely of the panel length as the width of the backing board beneath it, or by arranging shingles of predetermined repetitious unequal widths in an established series in all panels and offsetting the panels in adjacent courses lengthwise to stagger the cracks between the shingles in successive courses.

1 Claim, 12 Drawing Figures

Fig. 1.
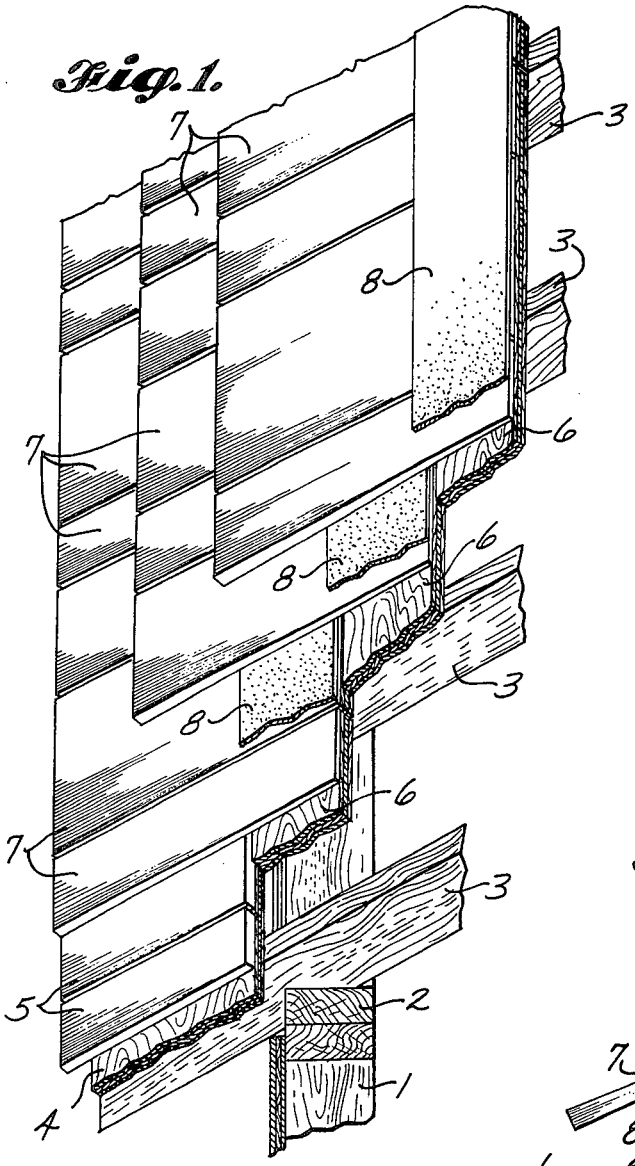
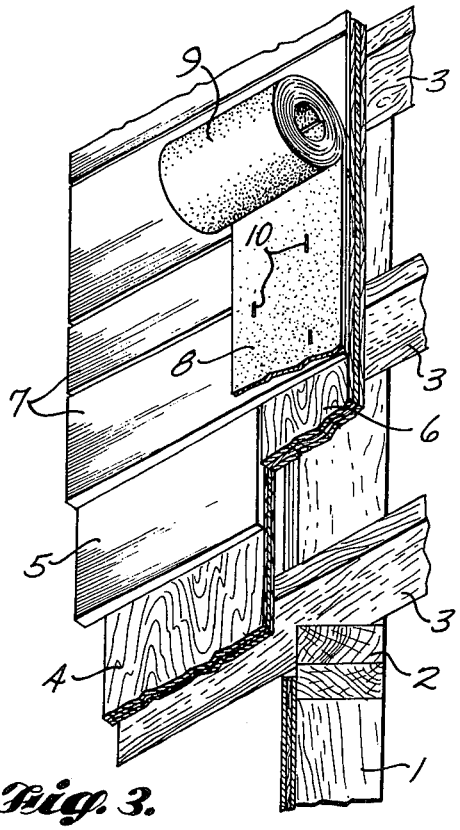
Fig. 3.
Fig. 2.
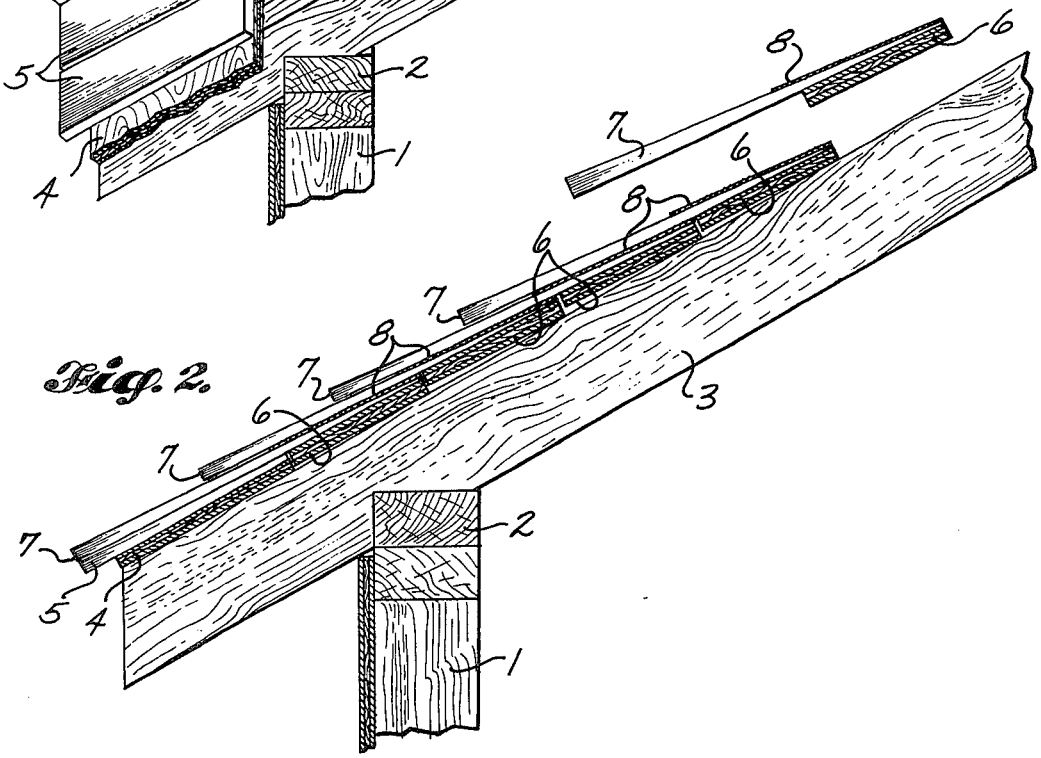

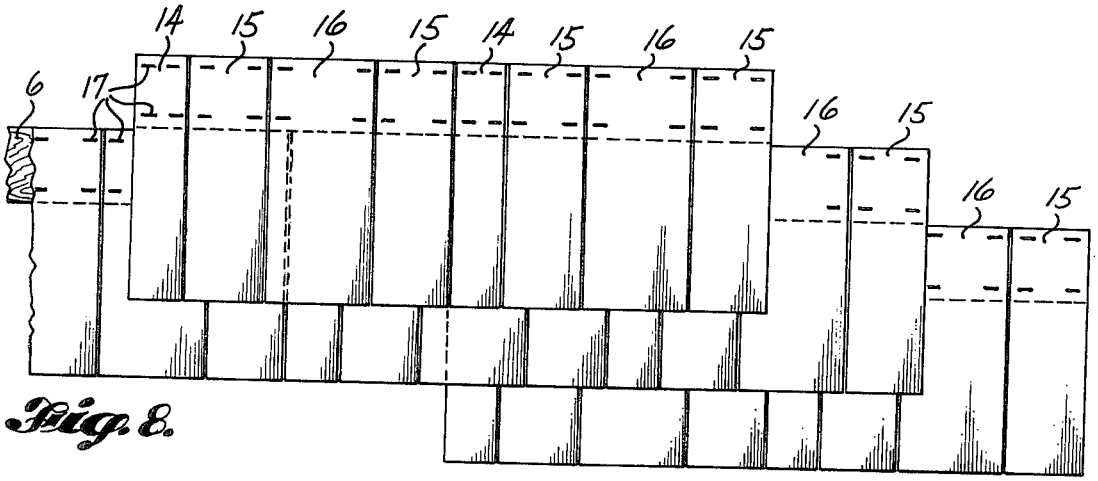
Fig. 8.
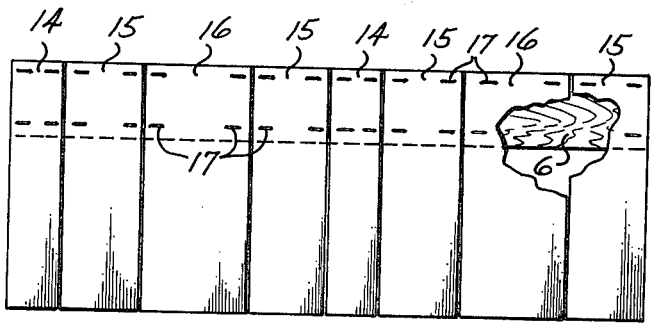
Fig. 7.
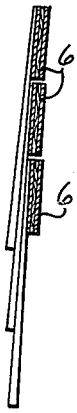
Fig. 9.
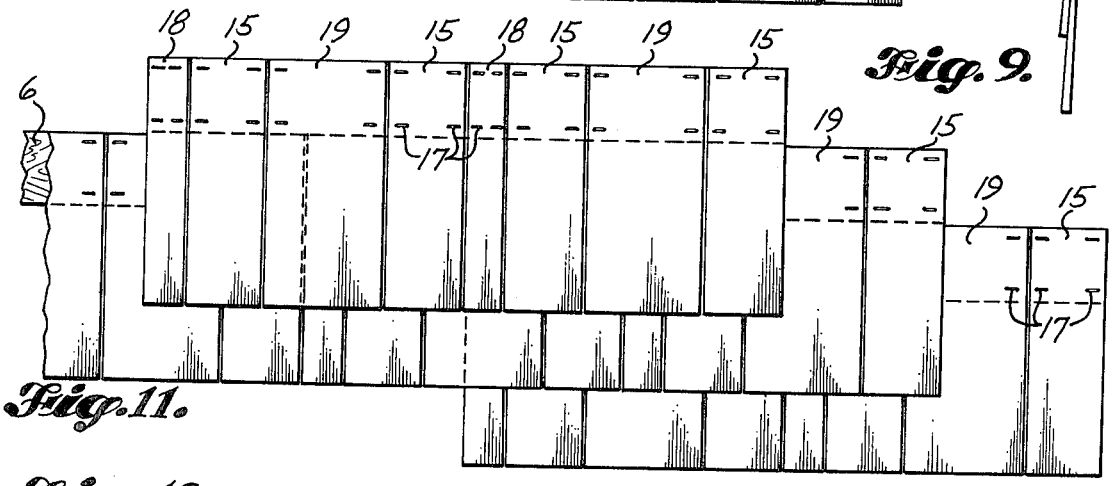
Fig. 11.
Fig. 10.
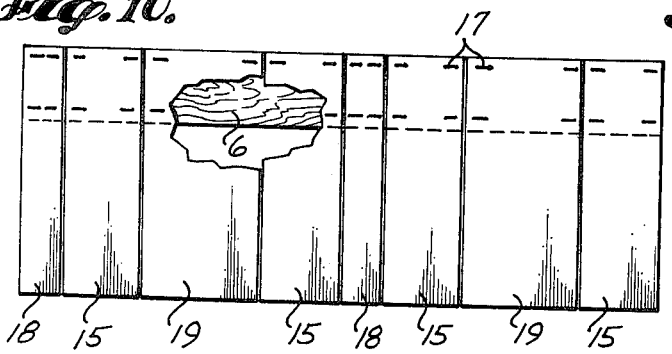
Fig. 12.
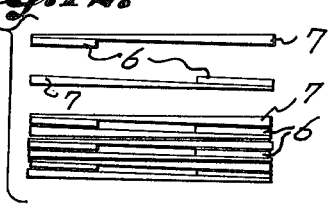

PREFABRICATED SHINGLE PANELS

This is a division of application Ser. No. 48,255, filed Jun. 22, 1970, now abandoned.

For the purpose of the present invention the designation "shingle" is used in its generic sense to mean a small thin piece of building material of wood or other substance which usually is tapered from butt to tip, but may be of uniform thickness, and which may be machine sawn, or split on both sides, or have one side sawn and its other side split.

A principle object of the present invention is to provide prefabricated shingle panels which, when assembled to form a roof or a side wall, result in the shingles being arranged in overlapping relationship generally comparable to the overlap resulting from applying shingles individually in a roof or a side wall and without joints between shingles in adjacent upper and lower courses in registration through successive shingle layers.

A further object is to utilize shingles which are all of substantially full length in the manufacture of the shingle panel, but which shingles need not be of precisely the same lengths.

Another object is to provide a type of prefabricated shingle panel construction which can be manufactured easily, quickly and accurately in a manufacturing plant instead of at the building construction site.

It is also an object to provide a shingle panel construction of the type which will enable a number of such panels to be assembled easily and compactly for shipping purposes, and which when packaged for shipping will be rugged so as to minimize risk of damage during shipment. In particular the tips of the shingles are backed for protection.

An important object of the invention is to provide prefabricated shingle panels which can be installed on a building easily and quickly by unskilled labor, and which will result in a roof or side wall having proper exposure width of the shingle courses and adequate breaking of the joints between the shingles in adjacent courses with a minimum of locating measurement being required.

An additional object is to provide a shingle panel which in being installed will automatically result in tight sheathing underlying the shingle covering.

Another object is to provide special prefabricated panels which can be used both for the starter course and for the ridge cap finishing course.

FIG. 1 is a top perspective of a section of a shingle roof made from prefabricated panels of the present invention with parts broken away, and FIG. 2 is a vertical section through such a roof showing one panel in exploded relationship to installed panels.

FIG. 3 is a top perspective of a section of a roof utilizing a slightly modified type of prefabricated panel.

FIG. 7 is a face view of a different type of prefabricated shingle panel according to the present invention, and FIG. 8 is a face view of a roof or wall section showing such panels in assembled relationship.

FIG. 9 is a transverse section through the panel assembly shown in FIG. 8.

FIG. 10 is a face view of a shingle panel incorporating shingles having dimensions different from those shown in the panel of FIG. 7, and FIG. 11 is a face view of a section of an assembly of panels such as shown in FIG. 10.

FIG. 12 is an end view of a shipping package of panels according to the present invention.

Figures 4, 5, 6:
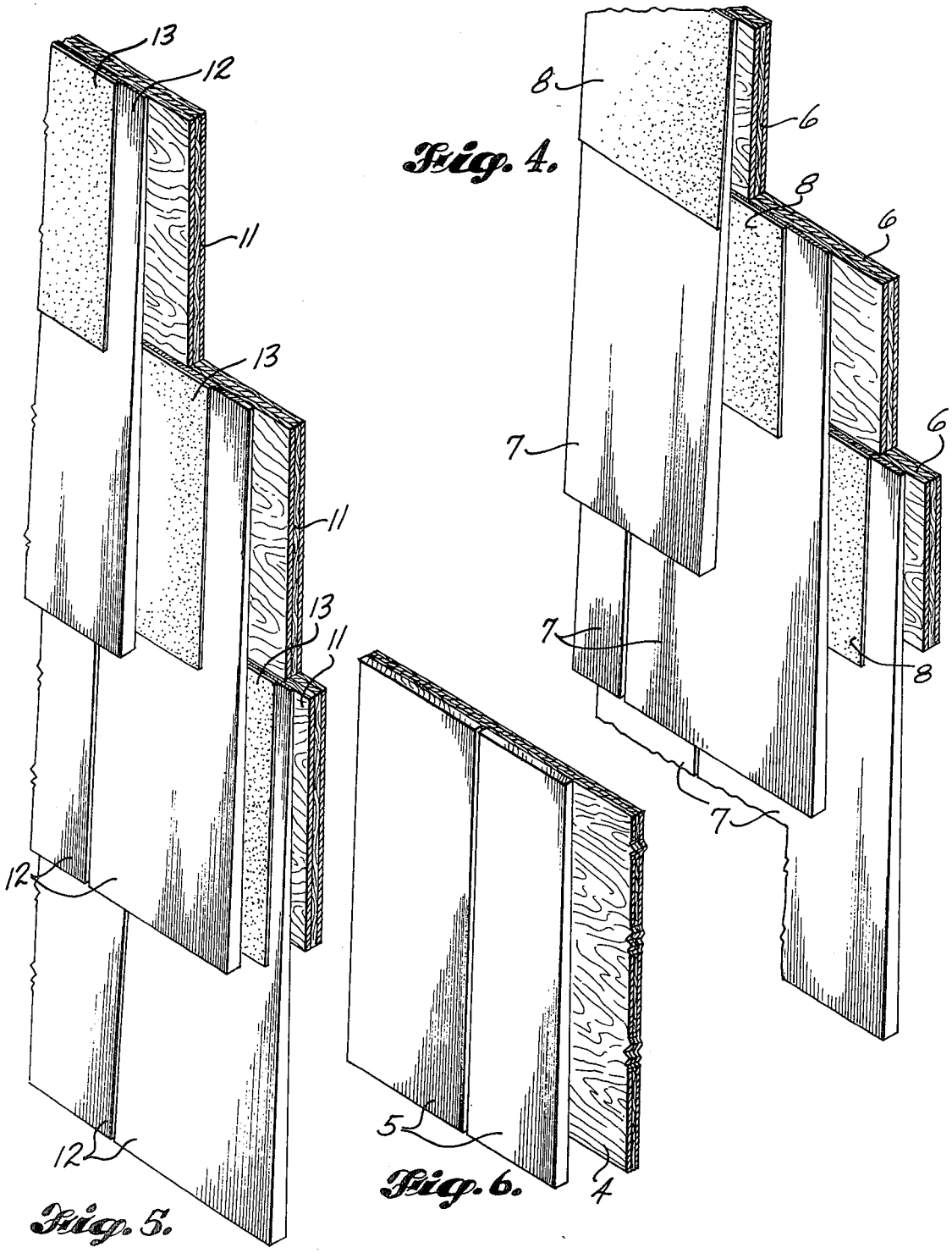
FIG. 4 is a top perspective of a section of a sidewall made from prefabricated shingle panels having proportions somewhat different from those shown in FIGS. 1, 2 and 3.
FIG. 5 is a top perspective of a section of a sidewall constructed of prefabricated panels of still different proportions.
FIG. 6 is a top perspective of a portion of a prefabricated panel to be used for a starter course or a finishing course.

Prefabrication of panels bearing shingles in various forms has been proposed, but they have all been more or less impractical because they were too large, or too small, or too heavy, or too expensive to manufacture, or too wasteful of wood, or too difficult to apply with unskilled labor, or defective in assembled condition so as to leak, or unattractive in appearance. The construction of the shingle panel of the present invention has overcome these various difficulties so as to provide a practical shingle panel which will accomplish the objects specified above.

The panel of the present invention can be installed easily and conveniently with a minimum waste of material both in fabrication and in installation. It is intended that the dimensions of the prefabricated panels fit conventional frame building construction. Such construction normally has 2 by 4 inch studs 1 spaced apart sixteen inches on centers which carry a double 2 by 4 inch plate 2. In the usual gable or hip roof 2 by 4 inch rafters 3 are notched to fit on the plate 2, as shown in FIGS. 1, 2 and 3.

Usually the rafters 3 are located 16 inches on center or 24 inches on center and are spanned by roof boards which are spaced apart, or are in edge abutment, as may be preferred by the builder. The shingles are then nailed to such roof boards individually through their tips. If the roof boards are spaced apart such spacing should match the width of the shingle butts exposed to the weather.

In order to construct a satisfactory roof the exposure width of the shingles must not be too great. Also, it is the responsibility of the workmen to select individual shingles of a width such that the cracks between the shingles in successive rows will be offset adequately. Particularly if a workman is being paid on a piecework basis he frequently does not take sufficient time to select shingles of proper width. If sufficient time is taken for such selection, either the piecework cost must be increased to attract workmen, or if the workmen are paid on a time basis the time required to lay the roof shingles must be increased, which also adds to the cost.

In accordance with the present invention the workman assembling the prefabricated panels of the present invention, whether on a roof or on a sidewall, is relieved of virtually all responsibility to select shingle width. All that is required is for the first panel of each course to be installed properly and the remainder of the panels will be assembled in sequence without concern about selection of panels or shingles whatever the length of the course may be.

Any roof or sidewall is started with a course of starter panels such as shown individually in FIG. 6 and in assembled relationship in FIGS. 1, 2 and 3. Such a starter course panel includes a backing board 4 which preferably is of plywood, but may be of lumber, and should be three-eighths of an inch to three-quarters of an inch in thickness. The shingles 5 are secured to the outer face of this backing board with their lengths extending transversely of the length of the backing board. These shingles have their tips cut off and their butts preferably overhang slightly the lower edge of the backing board 4. The length of this backing board preferably is four feet long for easy handling, but may be 8 feet long. The starter course panels are assembled on the lower edge of the roof so that the lower edge of the sheathing board is even with the ends of the rafters 3, as shown in FIGS. 1 and 2.

Over the starter course regular shingle panels are applied. Each of these regular panels includes a backing board 6 of a width equal to the width of shingle butt which it is desired to have exposed to the weather. The shingles 7 are secured to the outer surface of the backing board 6 with their lengths extending transversely of the length of the backing board and with the butt portions of the shingles overhanging the lower edge of the backing board a distance equal to the length of the shingles 5 of the starter course so that the butts of the first regular course of shingles will be flush with the butts of the starter course shingles 5. The first course of shingles will therefore be of double thickness as is customary in conventional shingle roof or sidewall construction.

It will be noted in FIGS. 1 and 2 that the backing board 6 of the lowest regular panel is installed with its lower edge in abutting relationship to the upper edge of the starter course panel backing board 4 so that the backing boards of the two courses are in substantially coplanar relationship. The tips of the shingles 7 do not project upward beyond the upper edge of the backing board 6 and the tips of at least some shingles may stop somewhat short of such upper edge, particularly if the shingles are somewhat unequal in length. Normally the butt ends of the shingles of each panel are substantially aligned, although such alignment is not mandatory. The butt ends may be somewhat misaligned intentionally where a particularly rustic appearance is desired.

When the prefabricated panels for the next course are installed, again the lower edge of each backing board 6 is placed in abutment with the upper edge of the next lower backing board so that the backing boards of all the courses are in substantially coplanar relationship. Since the butt ends of the shingles of all panels overhang the lower edges of the backing boards generally to the same extent, it will be seen that when successive courses of a roof or sidewall are assembled by the use of such panels the spacing between the butts of the shingles in adjacent courses, which determines the extent of the shingle butts exposed to the weather, will be approximately equal to the width of the backing boards. Consequently, no measuring is necessary on the job to lay the shingles with proper and uniform exposure.

Normally the panels in successive courses will be of equal horizontal length. It is desirable to offset the end joints between the panels lengthwise of the courses, and it is also desirable to have the joints between the adjacent ends of adjacent panels occur on rafters. Consequently, the first panel of each course will be started so that its inner end is offset at least by the spacing between two adjacent rafters from the ends of the panels in adjacent courses. It will therefore be necessary to cut the end panel of at least each alternate course to alter its length. The panels may, for example, be four feet long and the rafters may be spaced two feet on center. To start alternate layers a half-length panel would then be used.

In the panels shown in FIGS. 1 to 6 shingles of random width are applied to the backing boards at the factory. A suitable jig locates the backing board 6 and the butts of the shingles 7 to establish a uniform length of shingle-butt overhang when the shingle tips are bonded or stapled to the backing board. These panels are constructed so that it is not necessary for the workman applying the panels to select shingles of any particular width, except for possibly the end shingle. Alternatively, the end shingle can simply be trimmed to the desired width. Leakage through the cracks between adjacent shingles is prevented by providing a strip 8 which will be disposed between adjacent layers of shingles and which will be of a width greater than the width of the backing board it overlies so that water cannot penetrate through the assembled shingle courses.

The strip 8 can be of any suitable waterproof material, such as waterproof felt or metal strip, for example of aluminum. In FIGS. 1 and 2 the overhang of the butt portions of the shingles 7 in free cantilever fashion beyond the lower edge of the backing board 6 without any underlayer is shown as being considerably in excess of the portion of the shingle length backed by the board. The strip 8 overlies the tip portions of the shingles backed by the board 6 and is of a width to extend sufficiently below the lower edge of the backing board as to provide a substantial overlap over the upper edge of the backing board and strip 8 of the course next below that of the backing board which the strip 8 overlies.

Consequently, when the shingle panels are assembled in the manner shown in FIGS. 1 and 2, the strips 8 of the successive courses will be disposed in shingled relationship, and each strip will underlie the overhanging portion of the shingles in the shingle course next higher than that of the backing board which the strip overlies, so as to prevent leakage of water through cracks between shingles of random width in successive courses which may be in registration. Such water passing through the cracks will be shed from an upper strip 8 to the next lower strip. In most instances, of course, the cracks between the shingles in adjacent courses will not be in registry, so water passing through a crack between adjacent shingles will flow onto the strip 8 beneath such crack and then down onto the upper surface of a shingle in the next lower course.

Each strip 8 can be incorporated in a shingle panel at the factory by being secured in overlying relationship to the shingle tips and backing boards 6 as shown in FIGS. 1 and 2. Such strip can be secured to the shingle tips by suitable adhesive or by staples. The use of adhesive is preferred to avoid interference of staples with cutting of the panel to any desired length. If staples are used the same staples can secure the strip 8 to the shingle tips and the shingle tips to the backing board. Alternatively, the panels can be furnished without the strip 8, and such strip can be applied to successive courses during construction of the roof or sidewall as illustrated in FIG. 3. After the backing boards 6 have been nailed to the rafters 3, strip material from a roll 9 can be laid over the shingle tips and backing board of each layer and secured to the backing board by staples 10 before the next course of shingle panels is laid. In this case the strip can be run continuously across the end joints between panels.

The construction of the individual shingle panels and their assembly shown in FIGS. 4 and 5 is similar to that described in connection with FIGS. 1, 2 and 3. In this instance, however, the prefabricated panels are shown as being applied to a sidewall instead of to a roof. The panels shown in FIG. 4, composed of backing boards 6, shingles 7 and strips 8, are substantially the same as those shown in FIGS. 1 and 2. The dimensions of the parts of the panels shown in FIG. 4 are slightly different from the dimensions of the panel components shown in FIGS. 1 and 2. In FIGS. 1 and 2 the width of the backing board 6 is approximately 40 percent of the length of the shingles, whereas in FIG. 4 the width of the backing board is approximately 30 percent of the length of the shingles. The only effect of such difference in proportion is to alter the extent of exposure of the butt portions of the shingles when the panels have been assembled.

The shingle panels and assembly shown in FIG. 5 differ from those of FIGS. 1, 2 and 4 in dimensions in that the width of the backing boards 11 is about 45 percent of the length of the shingles 12. Consequently, the proportion of the shingles exposed to the weather is much greater than in the case of FIGS. 1, 2 and 4. In this construction, however, the width of the strips 13 is greater than in the previous instances. Here the lower edge of each strip 13 projects downward almost to the butt end of the shingles overlying such strip. Since each strip 13 is wider than the backing board of its panel, however, the strips in successive courses will still be disposed in partially overlapping shingled relationship.

The panel shown in FIG. 6, described as being for a starter course, will carry shingles 5 of a length equal to the overhang of the butt portions of shingles of the regular panels with which this starter course is to be used. Thus the shingles 5 for the starter course to be used with the regular panels shown in FIG. 4 will be longer than those used for the starter course to be combined with the regular panels of FIGS. 1 and 2. The shingles 5 of the starter course to be used with the regular panels of FIG. 5 will be even shorter. In making these statements it is assumed that the general length of the shingles used for constructing the regular panels of FIGS. 1, 4 and 5 will be the same, for example nominally 16 inches, 18 inches or 24 inches in length.

The width of the starting course backing board 4 in every instance will be greater than the width of the regular course backing board 6 or 11, because the major portion of the length of the shingles overhang the regular backing board in each instance by an amount substantially greater than the width of such backing board. In FIG. 6 the backing board 4 will be of waterproof character, but if it is not waterproof a protective strip like 8 or 16 should be applied over the full width of such backing board, and preferably should project beyond its lower edge a distance sufficient so that water will not run down the lower edge of the backing board but will drip off the lower edge of the protective strip.

The upper edge of the panel assembly section shown in FIGS. 1, 2, 3, 4 and 5 could be the upper edge of the complete roof or sidewall assembly. Starter panels such as shown in FIG. 6 can also be used as cap strips for a ridge roof overlying the upper portion of the upper regular panel course. Correspondingly the starter course panel of FIG. 6 could be used as the upper finishing course for a sidewall. In such instances it may be necessary to rip a backing board 6 or 11 lengthwise to fit properly onto the rafters or studs, and it may or may not also be necessary to rip off a portion of the shingle tip edge of the starter panel in making a finishing panel of it.

Panels such as shown in FIG. 6 may be used to make starter courses and finishing or cap courses for assemblies of regular prefabricated panels of the types shown in FIGS. 8, 9 and 11. The assembly of FIGS. 8 and 9 is constructed from prefabricated regular panels of the type shown in FIG. 7, and the assembly of FIG. 11 is constructed of regular panels of the type shown in FIG. 10. The panels both of FIG. 7 and of FIG. 10 are made of shingles of selected widths arranged in a particular pattern or predetermined series and secured to backing boards 6 so that it is not necessary to include in such panels or to apply to an assembly of such panel strips 8 or 13 described above.

The theory of the regular modular panels shown in FIGS. 7 and 10 is that they are constructed according to a type established for the present invention by their shingles being of different selected predetermined widths to form a predetermined series or pattern which may repeat within the length of a panel, and which will repeat from panel to panel because of such regularity. The shingles used at corresponding locations in all panels are alike in width and the shingles in all the panels are arranged in a corresponding predetermined series as to width, so that, if adjacent panels are offset by a predetermined amount, there will always be assurance that all of the cracks or joints between adjacent shingles in adjacent courses will be out of registration. It would, of course, be possible theoretically to use shingles of all the same width in making such panels, but this technique would be undesirable both from the point of view of monotony of appearance and from the point of view of the waste which would result in cutting the shingles to a uniform width if they were of wood. The same objections would apply in a lesser degree to panels made of shingles of only two widths.

In the panel shown in FIG. 7 the shingles 14 are nominally four inches in width, the shingles 15 are nominally six inches in width and the shingles 16 are nominally eight inches in width. Each panel is shown as being 48 inches in length and as being composed with the shingles arranged in the predetermined series or pattern 14, 15, 16, 15, 14, 15, 16, 15. In other words, the shingles in the series or width pattern of 4 inches, 6 inches, 8 inches, 6 inches, 4 inches, 6 inches, 8 inches, 6 inches. These dimensions are nominal dimensions because it is preferred that the length of the panel be exactly forty-eight inches. In order to provide cracks at the joints between adjacent shingles to allow for expansion the actual widths of the shingles would be somewhat less than that stated in each instance.

If panels of the type shown in FIG. 7 are offset lengthwise in successive courses in increments of twelve inches, each four-inch wide shingle 14 would be centered with respect to an eight-inch wide shingle 16 in the adjacent courses above and below it. If the studs or rafters are located twelve inches on center, the joints between adjacent ends of all panels would overlie a rafter. The tips of the shingles are secured to the backing boards 6 by staples 17, and the panels are secured to the studs or rafters by driving nails through the backing boards and shingle tips, which nails and staples will be covered by the overhanging butt portions of shingles in the next higher course.

The panel of FIG. 10 is fabricated from shingles 15 which are 6 inches in width, shingles 18 which are three inches in width, and shingles 19 which are 9 inches in width. The predetermined series of shingles is composed of the repetitive shingle pattern in this instance is 18, 15, 19, 15, 18, 15, 19, 15, providing a shingle nominal width pattern of 3 inches, 6 inches, 9 inches, 6 inches, 3 inches, 6 inches, 9 inches, 6 inches.

Again, if shingle panels of the type shown in FIG. 10 are assembled with the panels of adjacent courses offset lengthwise twelve inches, it will be found that each 3-inch shingle 18 will be centered with respect to a 9-inch shingle 19 in the adjacent course both above and below it. In this instance also if the rafters or studs are located 12 inches on center and the panels are 4 feet or 8 feet in length, each joint between the adjacent ends of adjacent panels will overlie a stud or rafter. Alternatively, suitable connecting means may be provided to connect the adjacent ends of adjacent backing boards without having a bearing member beneath the joint in each instance. The shingles of the panel 10 also are secured to the backing boards 6 by staples 17 passing through their tips.

Assemblies of panels having predetermined series of shingles or shingle width patterns either of the type shown in FIG. 7 or of the type shown in FIG. 10 will repeat in alternate courses. Different shingle width patterns can be utilized, but the patterns should not be in registry in adjacent courses, because that would place the cracks between adjacent shingles in registry. Even though the panels are assembled so that shingles of the same width are in registry in alternate courses, the difference in shingle widths in the pattern is such that no impression of monotony will be produced such as will result from the use of shingles all of a single width.

It will be understood that in assembling prefabricated shingle panels of any of the types discussed above it is only necessary to start each course with the panel located in the proper lengthwise offset relationship to the end panel in the next lower course. The panels are assembled directly on the studs or rafters with the backing boards in substantially edge-abutting relationship. Such disposition of the backing boards automatically sets the width of shingle butt exposure to the weather without measuring. The combination of the backing boards automatically produces a solid sheathing of backing boards in substantially coplanar relationship beneath the shingles. Also because there is no sheathing above the particular course being laid, it is easy for the workman to make sure that the nails driven through the shingle tips and backing boards are driven into the studs or rafters which are exposed immediately above the course of panels being laid.

The resulting roof or sidewall has at least two layers of shingles overlapping at all locations, and has three layers overlapping in much of the area, just as in a roof in which individual shingles are laid on the job. Consequently, the roof or sidewall constructed from prefabricated panels according to the present invention is the full equivalent of a roof or sidewall produced on the job by assembly of individual shingles.

The prefabricated shingle panels described above can be packaged readily for shipment in the manner illustrated in FIG. 12. The backing boards of two panels can be placed in spaced apart edgewise registry with the butt portions of the shingles secured to one backing board overlying the backing board of the other panel. Each backing board will protect the butt portions of the shingles of the other paired panel. Any number of panels desired may be stacked in this relationship and bound together in a package or placed in a carton for shipment. The edge portions of such a package will be solid wood so as to minimize damage to the shingles.

We claim:

1. A prefabricated regular modular shingle panel comprising an elongated backing board of substantially rectangular cross section, and only a single course of several individual wooden shingles, each shingle having a tip portion and a butt portion and being tapered in thickness away from said butt portion toward said tip portion, and said shingles being arranged with their lengths extending transversely to the length of said backing board, with their tip portions overlying and secured to said backing board and with their butt portions overhanging one edge of said backing board in free cantilever fashion without any underlayer for a distance at least as great as the width of said backing board, said course of shingles including at least three shingles of different selected predetermined widths in the direction lengthwise of said backing board arranged in each of at least two repetitive identical series of such selected predetermined widths, and said backing board being of a length to extend continuously at least throughout said two repetitive predetermined series of shingles in said course.

* * * * *

UNITED STATES PATENT AND TRADEMARK OFFICE

CERTIFICATE OF CORRECTION

PATENT NO. : 4,102,107

DATED : July 25, 1978

INVENTOR(S) : Frank S. Barker et al.

It is certified that error appears in the above-identified patent and that said Letters Patent are hereby corrected as shown below:

Title page, (56) References Cited, cancel "2,172,010" and insert -- 2,171,010 --.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*